US005236787A

United States Patent [19]

Grassi

[11] Patent Number: 5,236,787

[45] Date of Patent: Aug. 17, 1993

[54] THERMAL BARRIER COATING FOR METALLIC COMPONENTS

[75] Inventor: John A. Grassi, Princeville, Ill.

[73] Assignee: Caterpillar Inc., Peoria, Ill.

[21] Appl. No.: 737,284

[22] Filed: Jul. 29, 1991

[51] Int. Cl.[5] ..... B22F 1/02

[52] U.S. Cl. ..... 428/552; 428/548; 428/551; 428/553; 428/554; 428/561; 428/539.5; 428/564; 428/565

[58] Field of Search ..... 428/548, 551, 552, 553, 428/554, 561, 567, 568, 539.5, 564, 565, 545

[56] References Cited

U.S. PATENT DOCUMENTS

| | | | |
|---|---|---|---|
| 3,091,548 | 5/1963 | Dillon | 117/70 |
| 3,324,543 | 6/1967 | McVey et al. | 29/472.9 |
| 3,911,891 | 10/1975 | Dowell | 123/191 A |
| 4,495,907 | 1/1985 | Kamo | 123/193 C |
| 4,588,607 | 5/1986 | Matarese et al. | 427/34 |
| 4,713,300 | 12/1987 | Sowman et al. | 428/547 |
| 4,956,137 | 9/1990 | Dwivedi | 264/60 |

OTHER PUBLICATIONS

W. F. Calosso, et al, "Process Requirements for Plasma Sprayed Coatings for Internal Combustion Engine Components", *The American Society of Mechanical Engineers*, 87-Ice-15, Feb. 1987, pp. 1-8.

*Primary Examiner*—Donald P. Walsh
*Assistant Examiner*—Chrisman D. Carroll
*Attorney, Agent, or Firm*—Robert A. McFall

[57] ABSTRACT

A coating for a metallic substrate has a metallic bond coat, a metallic seal coat and a centrally disposed layer of ceramic material. Transition layers comprising a controllably positioned mixture of metallic and ceramic materials are interposed, respectively, between the bond coat and the central layer of ceramic material, and between the seal coat and the central layer of ceramic material. The coating provides a desirable thermal barrier for internal engine components. Further, the coating is graded to avoid harmful internal thermal stress between dissimilar materials in the coating, and has a sealed external surface that is resistant to corrosion, erosion, hot gas infiltration, and wear during operation in an internal combustion engine.

22 Claims, 1 Drawing Sheet

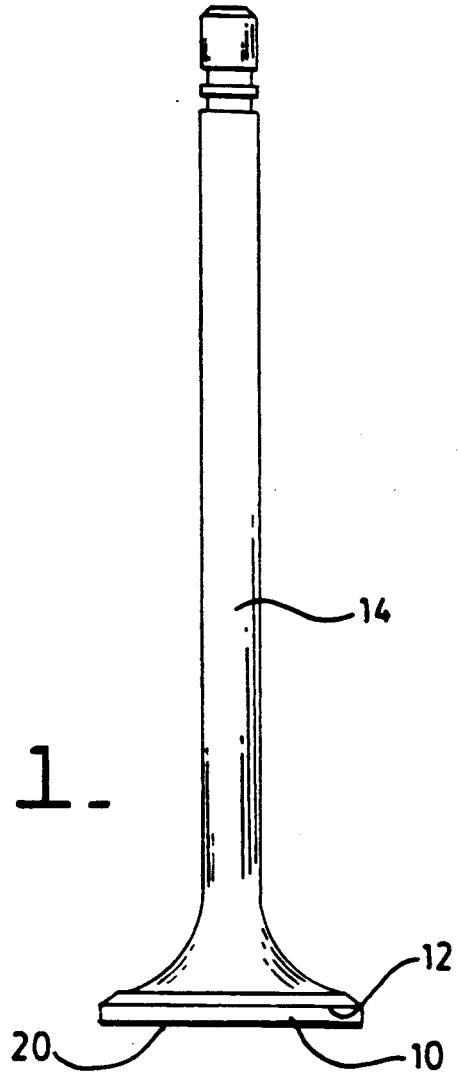
Fig. 1.
Fig. 2.
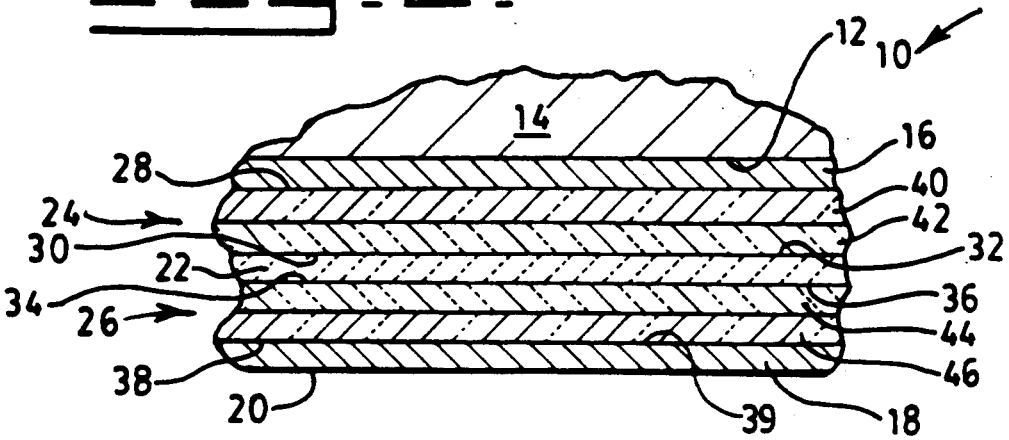

THERMAL BARRIER COATING FOR METALLIC COMPONENTS

TECHNICAL FIELD

This Invention relates generally to a thermal barrier coating for metallic surfaces and more particularly to a thermally insulating coating for internal engine components.

BACKGROUND ART

The value of thermal barrier coatings on internal surfaces of engines is well recognized. For example, U.S. Pat. No. 4,495,907 issued Jan. 29, 1985 to Roy Kamo describes a thermally insulating coating, for combustion chamber components, composed of a plurality of metal oxides. After application of a bond coat, Kamo deposits a layer of thermally insulative material that is then impregnated with a chromium solution. Preferably the chromium solution penetrates substantially through the thermally insulative material and contacts the substrate. Upon heating, the chromium solution is converted to a refractory metal oxide that seals the surface of the thermally insulative material. This process requires a repetition of the impregnation and heating cycles, e.g., 5 or 6 times, to effect penetration of the impregnating solution. Not only is this process time consuming, and therefore costly, but impregnation of the thermally insulative material reduces the porosity of the insulative material and thereby compromises the thermal insulative properties of the coating.

A continuously graded metallic-ceramic coating for metallic substrates is disclosed in U.S. Pat. No. 4,588,607, issued May 13, 1986 to A. F. Matarese et al. The coating taught by this patent is applied to a metal substrate and includes a metallic bond coat, a continuously graded metallic-ceramic layer, and an abradable outer layer of ceramic material. During deposition of the coating, the metal substrate temperature is modulated to produce a desirably low residual stress pattern in the graded layer. This coating, however, does not provide an outer surface that is resistant to corrosion, erosion, or infiltration by the hot gases present in a combustion chamber during operation of an engine.

The present invention is directed to overcoming the problems set forth above. It is desirable to have an effective thermal barrier coating for metal substrates that not only avoids high stresses at the interface of dissimilar materials, but also has an outer surface that is effectively sealed against infiltration of hot fuel gases. Furthermore, it is desirable to have such a thermal barrier coating in which the thermal insulating properties of the primary insulating material are not compromised by impregnation of a sealant.

DISCLOSURE OF THE INVENTION

In accordance with one aspect of the present invention, a coating for a metallic substrate includes a metallic bond coat bonded to the metallic substrate, a first transition layer bonded to the metallic bond coat, a layer of ceramic material bonded to the first transition layer, a second transition layer bonded to the layer of predominately ceramic material, and a metallic seal coat that is bonded to the second transition layer. The metallic bond coat has a coefficient of thermal expansion substantially equal to that of the metallic substrate. The first transition layer has a composition comprising a mixture of metallic and ceramic materials which are controllably positioned within the first transition layer with the composition at a surface of the first transition layer adjacent the bond coat being at least about 50% metallic material, and the composition at a surface adjacent the layer of ceramic material being at least about 50% ceramic material. The second transition layer has a composition comprising a mixture of metallic and ceramic materials which are controllably positioned within the second transition layer with the composition at a first surface of the second transition layer adjacent the layer of ceramic material being at least about 50% ceramic material and the composition at a second surface adjacent the metallic seal coat being at least about 50% metallic material. The material comprising the layer of ceramic material has a coefficient of thermal diffusivity of less than about 0.005 $cm^2/sec$. Also, the metallic seal coat has a porosity of less than about 5%.

Other features of the coating for a metallic substrate include the metallic bond and seal coats having an oxidation resistant refractory metal composition.

BRIEF DESCRIPTION OF THE DRAWINGS

FIG. 1 is an elevational view of an engine valve having a coating, embodying the present invention, on its face surface; and, FIG. 2 is a partial cross-sectional view of the engine valve shown in FIG. 1 showing the coating embodying the present invention in enlarged detail.

BEST MODE FOR CARRYING OUT THE INVENTION

In the preferred embodiment of the present invention, a coating 10 having thermal insulating properties is applied to a face surface 12 of an engine valve 14. The coating 10 has a metallic bond coat 16 bonded to the valve 14 at the face surface 12, and a metallic seal coat 18 defining an outer, external surface 20. The external surface 20 of the coating 10 is exposed, during engine operation, to hot, high velocity and high pressure gases. These gases carry products of combustion that tend to corrode, erode or otherwise wear surfaces that are exposed to the gases.

Importantly, the coating 10 also has a centric, i.e., a centrally disposed, layer 22 constructed of a predominately ceramic material having low heat transfer properties. The centric layer 22 is the primary barrier to conduction of heat through the coating.

The coating 10 further includes transition layers 24,26 between the centric layer of ceramic material 22 and, respectively, the metallic bond coat 16 and the metallic seal coat 18. More specifically, the first transition layer 24 has a first surface 28 bonded to the metallic bond coat 16, and a second surface 30, spaced from the first surface 28, that is bonded to a first surface 32 of the centric layer 22. In like manner, the second transition layer 26 has a first surface 34 bonded to a second surface 36 of the centric layer 22, and a second surface 38, spaced from the first surface 34 of the second transition layer, which is bonded to the metallic seal coat 18.

Preferably, in forming the coating 10, metallic and ceramic powder materials are deposited by plasma spray deposition and are continuously graded or modulated during the application process. That is, the composition of the powder materials introduced into the plasma jet, or stream, is gradually modulated from essentially, i.e., at least about 90%, metallic material at the interface with the substrate surface 12, to a predominately, i.e., more than 70%, ceramic material at the center portion 22 of the coating 10, after which the composition of the deposition is modulated gradually, in reverse order, from predominately ceramic to essentially metallic at the external surface 20 of the seal coat 18. The coating thus varies from an essentially metallic composition at the bond coat 16 to a predominately ceramic composition in the centric layer 22 and then, in reverse order, back to an essentially metallic composition at the external seal coat 18.

As indicated above, "essentially" as used herein in the specification and the claims means containing at least 90% of the specified material or composition. The term "consisting essentially of" and the word "predominately" are used interchangeably and mean that the subject composition contains at least 70% of the specified material. The word "primarily", as used herein means that the composition contains more than 50% of the specified material.

Importantly, the term "surface" as applied to the respective layers comprising the coating 10 may be either a physical surface formed when the plasma spray deposition process is interrupted and the material composition changed, or it may be the position in the coating at which the continuously modulated material changes from the material composition defined by one layer to the material defined by the adjacent layer. For example, the bond coat 16 is defined herein as being essentially, i.e., at least 90%, metallic in composition. The adjacently disposed first transition layer 24 is defined as having a composition that, at its first surface 28, contains at least about 50% metallic material. Thus, in a continuously graded, or modulated, deposition, the "surface between the bond coat 16 and the first transition layer 24 is the position between the bond coat and first transition layer at which the metallic component of the mixture is not essentially metallic, i.e., the metallic component of the composition is less than 90%.

Also, the term "bonded" as used herein means either a physical or metallurgical joining of adjacent discrete layers, or joining which occurs as the result of a continuously modulated change in composition of the materials defining adjacently disposed layers.

Both of the metallic coats, i.e, the bond coat 16 and the seal coat 18 are preferably formed by the plasma spray deposition of an oxidation resistant refractory metal powder material. Examples of some oxidation resistant refractory metal materials suitable for use in the bond and seal coats 16,18, include:

| |
|---|
| Co with 30Cr, 20W, 5Ni and 1V |
| Ni with 22Cr, 20Fe and 9Mo |
| Ni with 17Cr, 17Mo, 6Fe and 5W |
| Ni with 17.5Cr, 5.5Al, 2.5Co and $0.5Y_2O_3$ |
| Ni with 5Al and 5Mo |
| Fe with 24Cr, 8Al and 0.5Y |
| CoCrAlY |
| FeCrAl |
| FeCrAlY |
| FeCr |
| NiCr |
| NiCrFe |
| NiAl, and |
| Stainless steel wth $5ZrO_2$. |

To avoid high stresses between the substrate 14 and the bond coat 16, it is important that the bond coat be formed of a material having thermal expansion characteristics similar to that of the substrate. Typically, the valve 14 is formed of a high nickel-chromium steel material having a coefficient of thermal expansion of about $13\times10^{-6}$/°C. A suitable material for the bond coat is a low-thermally conductive ceramic material represented by the formula $NiCrCoAlY_2O_3$, and comprising about 75% nickel, about 17.5% chromium, about 5.5% aluminum, about 2.5% cobalt, and about 0.5% yttria. This material also has a coefficient of thermal expansion of about $13\times10^{-6}$/°C. Desirably, the bond coat 16 has a thickness of from about 0.13 mm (0.005 in) to about 0.30 mm (0.012 in), and preferably about 0.20 mm (0.008 in).

The centric layer 22 is preferably formed by the plasma spray deposition of a powder material which, after deposition and solidification, has a coefficient of thermal diffusivity of less than about 0.005 $cm^2$/sec, and may advantageously, as explained below, vary in porosity. Examples of some low-thermally conductive materials suitable for use as the predominate constituent of the centric layer 22 include:

| | |
|---|---|
| $Cr_2O_3$ | $Al_2O_3$ |
| $ZrO_2$ | CrC—NiCr |
| $45Cr_2O_3$—$55TiO_2$ | $ZrO_2$—$CeO_2$—$Y_2O_3$ |
| $BaTiO_3$ | $BaZrO_3$ |
| $CaTiO_3$ | $CaZrO_3$ |
| $CeO_2$ | Mullite |
| MgO—$Al_2O_3$ spinel | MgO—$Al_2O_3$—$ZrO_2$ spinel |
| $SrZrO_3$ | $ZrSiO_4$ |
| $CaSiO_4$ | $ZrB_2$ |
| ZrC | $Al_2O_3$—$TiO_2$ |
| $ZrO_2$—$TiO_2$—$Y_2$ | Mg—$ZrO_2$ |
| $Al_2O_3$—NiAl | $ZrO_2$—NiAl |
| Mg—$ZrO_2$—NiAl | Sc-stab $ZrO_2$. |

In the preferred embodiment of the present invention, the centric layer 22 beneficially comprises a mixture of about 75% of a low-thermally conductive ceramic powder material comprising from about 71% to about 74% Zirconia ($ZrO_2$), from about 24% to about 26% Cerium Oxide ($CeO_2$) and from about 2% to about 3% yttria ($Y_2O_3$) and about 25% of the above-described preferred oxidation resistant refractory metal powder ($NiCrAlCoY_2O_3$). The centric layer 22, comprising about 75% of the ceramic material and about 25% of the metallic material, has a coefficient of thermal diffusivity of about 0.0046 $cm^2$/sec (at room temperature). Desirably, the centric layer 22 has a thickness of from about 0.13 mm (0.005 in) to about 0.76 mm (0.030 in), and preferably about 0.20 mm (0.008 in).

During deposition of the centric layer 22, the porosity of the predominately ceramic material may be controlled, as is known in the art, to provide sufficient density at the first and second surfaces 32,38 to assure good bonding with the adjacent transition layers 22,24, and less density away from the first and second surfaces to provide a predetermined amount of porosity in the middle of the centric layer 22 for enhanced thermal insulation properties.

Each of the transition layers 24,26 have a composition containing a mixture of ceramic and metallic materials. The composition of the first transition layer 24 is controllably deposited so that the composition of the mixture at the first surface 28, adjacent the bond coat 16, contains at least about 50% metallic material and the composition at the second surface, adjacent the centric layer, contains at least about 50% ceramic material. In like manner, the composition of the second transition layer 26 is controllably deposited so that the composition of the mixture at the first surface 34, adjacent the centric layer, contains at least 50% ceramic material, and the composition at the second surface 38, adjacent the seal coat 18, contains at least about 50% metallic material.

In the preferred embodiment of the present invention, the composition of the material within each of the transition layers 24,26 is varied to further reduce thermal stresses between adjacent layers of the coating during heating, cooling and operation in an engine environment. As described below in more detail, each of the transition layers 24,26 include primary and secondary layers or zones in which the composition of the material in each of the primary and secondary layers contain more than 50% of the material comprising the adjacently disposed bond coat 16, seal coat 18 or centric layer 22. For example, the mixture of ceramic and metallic materials in the first transition layer 24 may be controllably positioned so that the composition at the first surface 28 is primarily, i.e., more than 50%, the same metallic material as the bond coat 16, and the composition at the second surface 30 is primarily the same ceramic material as the material comprising the centrally disposed layer of ceramic material 22.

More specifically, the first transition layer 24 has a primary layer 40 disposed adjacent the metallic bond coat 16, and a secondary layer 42 interposed the primary layer 40 and the centrally disposed layer 22 of ceramic material. The primary layer 40 of the first transition layer 24 is primarily metallic in composition, and the secondary layer 42 is primarily ceramic. Desirably, the primary layer 40 has a composition comprising from about 51% to about 70% of the metallic material comprising the bond coat 16, i.e., $NiCrAlCoY_2O_3$, with the balance being the ceramic material comprising the predominate component of the centrally disposed layer 22, i.e., $ZrO_2$-$CeO_2$-$Y_2O_3$. Preferably, the primary layer 40 has a composition comprising about 67% of the metallic material and about 33% of the ceramic material.

The secondary layer 42 of the first transition layer 24, positioned adjacent the centrally disposed ceramic layer 22 has a composition that is primarily ceramic. Desirably, the secondary layer 42 has a composition comprising about 51% to about 70% of the same ceramic material comprising the predominate component of the centric layer 22, i.e., $ZrO_2$-$CeO_2$-$Y_2O_3$, with the balance being the same metallic material comprising the metallic bond coat 16, i.e., $NiCrAlCoY_2O_3$. Preferably, the secondary layer 42 has a composition comprising about 67% of the ceramic material and about 33% of the metallic material.

In a similar manner, the second transition layer 26 has a primary layer 44 disposed adjacent the centrally disposed layer of ceramic material 22, and a secondary layer 46 interposed the primary layer 44 and the outer metallic seal coat 18. The primary layer 44 of the second transition layer 26 is primarily ceramic in composition, and the secondary layer 46 is primarily metallic. Desirably, the primary layer 44 has a composition comprising from about 51% to about 70% of the same ceramic material which is predominate in the composition of the adjacent centric layer 22, i.e, $ZrO_2$-$CeO_2$-$Y_2O_3$, with the balance being metallic, i.e., a composition represented by the formula $NiCrAlCoY_2O_3$. Preferably, the primary layer 44 of the second transition layer 26 has a composition comprising about 67% of the ceramic material and about 33% of the metallic material.

The secondary layer 46 of the second transition layer 26, disposed adjacent the outer metallic seal coat 18, has a composition that is primarily metallic. Desirably, the secondary layer 46 has a composition comprising from about 51% to about 70% of the above described metallic material, i.e., $NiCrAlCoY_2O_3$, as in the metallic seal coat 18, with the balance being the ceramic material, i.e, $ZrO_2$-$CeO_2$-$Y_2O_3$.

In both of the transition layers 24,26 ,the primary layers 40,44 and the secondary layers 42,46 are preferably formed by plasma spray deposition, and may be applied in separate operations or, more expeditiously, in a single operation wherein the composition of the deposited material is modulated during application.

In the preferred embodiment of the present invention, the respective thickness of each of the primary and secondary layers 40,42,44,46 of the first and second transition layers 24,26 is desirably from about 0.13 mm (0.005 in) to about 0.30 mm (0.012 in). Thus, each of the transition layers 24,26 have a total thickness of from about 0.26 mm (0.010 in) to about 0.60 mm (0.024 in). Preferably, the total thickness of each of the first and second transition layers 24,26 is about 0.40 mm (0.016 in).

In an alternate embodiment of the present invention, the composition of the material comprising the transition layers 24,26 may be a 50/50 blend of ceramic and metallic powders and thereby, being controllably deposited at a predetermined position in the coating 10, satisfy the requirement that the composition of the transition layers contain at least about 50% of the material comprising the respective adjacent bond coat 16, seal coat 18 or centric layer 22.

The seal coat 18 has a first surface 39, spaced from the external surface 20, that is bonded to the second surface 38 of the second transition layer 26. As described above, the seal coat 18 is formed by the plasma spray deposition of an oxidation resistant refractory metal material, e.g., $NiCrAlY_2O_3$. During deposition, the plasma spray process parameters, such as voltage, stand-off distance and substrate temperature controlled to assure the formation of a dense layer of the metallic material. After deposition and solidification, the metallic seal coat 18 should be continuous, uniform, free of microcracks, and have a porosity of less than about 5%. In addition to providing a gas-impervious seal for the underlying ceramic-containing layers, it is necessary that the seal coat 18 have sufficient thickness to accommodate a predetermined amount of wear and corrosion. For these reasons, the seal coat 18 desirably has a thickness of from about 0.13 mm (0.005 in) to about 0.30 mm (0.012 in), and preferably about 0.20 mm (0.008 in).

In an illustrative example, a thermal barrier coating 10, embodying the present invention, was formed by the plasma spray deposition of the above described preferred metallic and ceramic materials, i.e., $NiCrAlCoY_2O_3$ as the metallic material, and the specified blend of 71%–74% $ZrO_2$, 24–26% $CeO_2$, and 2–3% $Y_2O_3$ as the ceramic material. The valve 14 had a high-nickel chromium steel composition, and the bond coat 16 was deposited, after cleaning and preparation of the valve face surface 12, directly onto the valve face. The bond coat 16 had a composition comprising 100% of the above metallic material. The coefficient of thermal expansion for the valve 14 and the bond coat 16 is $13\times10^{-6}/°C$. The first transition layer 24 was deposited over the bond coat and had a composition comprising 50% of the above metallic material and 50% of the above described ceramic material. The centric layer 22, deposited over the first transition layer 24, had a composition comprising 75% of the $ZrO_2$-$CeO_2$-$Y_2O_3$ ceramic material and 25% of the metallic material. The thermal diffusivity of the centric layer was 0.0046 $cm^2$/sec. The second transition layer 26, was deposited over the centric layer 22 and had the same composition as the first transition layer 24, i.e., a 50/50 blend of the ceramic and metallic materials. The seal coat 18, deposited over the second transition layer 26 had a composition comprising 100% of the metallic material and a porosity of about 4%. Each of the layers, i.e., the bond coat 16, the first transition layer 24, the centric layer 22, the second transition layer 26, and the seal coat 18, had a thickness of about 0.20 mm (0.008 in). Thus, the overall thickness of the thermal barrier coating 10 was about 1.0 mm (0.039 in).

Industrial Applicability

The coating 10 embodying the present invention is particularly useful as a thermal barrier coating on the internal surfaces, such as valve faces and piston crowns, of internal combustion engines.

An engine valve 14, having the thermal barrier coating 10 identified above as being an illustrative example of the preferred embodiment of the present invention, was installed in a diesel engine and operated for 300 hours. Upon removal after the 300 hours of operation, the valve was examined. There was no visual evidence of corrosion, erosion, separation or debonding either at the substrate interface or within the coating, or other evidence of physical damage or deterioration. Furthermore, there was no measurable wear on the coating.

Other aspects, objects and advantages of this invention can be obtained from a study of the drawing, the disclosure, and the appended claims.

I claim:

1. A coating for a metallic substrate, comprising:

a metallic bond coat having a coefficient of thermal expansion substantially equal to that of said metallic substrate and being bonded to said metallic substrate;

a first transition layer having a first surface, a second surface spaced from said first surface, and a composition comprising a mixture of a metallic material and a ceramic material, said first surface being bonded to said metallic bond coat, and said mixture of said metallic and ceramic materials being controllably positioned within said first transition layer with the composition of said first transition layer at said first surface being at least about 50% the metallic material and the composition of said first transition layer at said second surface being at least about 50% the ceramic material;

a centric layer having a first surface and a second surface spaced from said first surface, said first surface of the centric layer being bonded to the second surface of said first transition layer, and said centric layer having a composition consisting essentially of a low-thermally conductive ceramic material;

a second transition layer having a first surface, a second surface spaced from said first surface, and a composition comprising a mixture of a metallic material and a ceramic material, said first surface being bonded to said second surface of the centric layer, and said mixture of the metallic and ceramic materials being controllably positioned within said second transition layer with the composition of said second transition layer at said first surface being at least about 50% the ceramic material and the composition of said second transition layer at said second surface being at least about 50% the metallic material; and, a metallic seal coat having a first surface bonded to the second surface of said second transition layer and a porosity not greater than about 5%.

2. A coating for a metallic substrate, as set forth in claim 1, wherein said metallic bond coat is formed of an oxidation resistant refractory metal material.

3. A coating for a metallic substrate, as set forth in claim 2, wherein said oxidation resistant refractory metal material comprising said metallic bond coat has a composition comprising about 75% nickel, about 17.5% chromium, about 5.5% aluminum, about 2.5% cobalt, and about 0.5% yttria.

4. A coating for a metallic substrate, as set forth in claim 1, wherein said metallic bond coat has a thickness of from about 0.13 mm to about 0.30 mm.

5. A coating for a metallic substrate, as set forth in claim 4, wherein said metallic bond coat has a thickness of about 0.20 mm.

6. A coating for a metallic substrate, as set forth in claim 1, wherein said first transition layer comprises a primary layer and a secondary layer, said primary layer being disposed adjacent said metallic bond coat and having a composition comprising from about 51% to about 70% of an oxidation resistant refractory metal material and from about 30% to about 49% of a low-thermally conductive ceramic material, and said secondary layer being interposed between said primary layer and said centric layer and having a composition comprising from about 51% to about 70% of a low-thermally conductive ceramic material and from about 30% to about 49% of an oxidation resistant metallic material.

7. A coating for a metallic substrate, as set forth in claim 6, wherein the composition of the primary layer of said first transition layer comprises about 67% of said metallic material and about 33% of said ceramic material, and the composition of the secondary layer comprises about 67% of said ceramic material and about 33% of said metallic material.

8. A coating for a metallic substrate, as set forth in claim 1, wherein said first transition layer has a thickness of from about 0.13 mm to about 0.60 mm.

9. A coating for a metallic substrate, as set forth in claim 8, wherein the thickness of said first transition layer is about 0.40 mm.

10. A coating for a metallic substrate, as set forth in claim 1, wherein said low-thermally conductive ceramic material has a coefficient of thermal diffusivity of less than about 0.005 $cm^2$/sec.

11. A coating for a metallic substrate, as set forth in claim 10, wherein said low-thermally conductive ceramic material has a composition comprising from about 71% to about 74% $ZrO_2$, from about 24% to about 26% $CeO_2$, and from about 2% to about 3% $Y_2O_3$.

12. A coating for a metallic substrate, as set forth in claim 1, wherein said centric layer has a density at a position equidistant from the first and second surfaces of said layer that is less than the density of said material at said first and second surfaces.

13. A coating for a metallic substrate, as set forth in claim 1, wherein said centric layer of ceramic material has a thickness of from about 0.13 mm to about 0.30 mm.

14. A coating for a metallic substrate, as set forth in claim 13, wherein said centric layer of ceramic material has a thickness of about 0.20 mm.

15. A coating for a metallic substrate, as set forth in claim 1, wherein said second transition layer comprises a primary layer and a secondary layer, said primary layer being disposed adjacent said centric layer and having a composition comprising from about 51% to about 70% of a low-thermally conductive ceramic material and from about 30% to about 49% of an oxidation resistant refractory metal material, and said secondary layer being interposed between said primary layer of the second transition layer and said metallic seal coat and having a composition comprising from about 51% to about 70% of an oxidation resistant refractory metal material and from about 30% to about 49% of a low-thermally conductive ceramic material.

16. A coating for a metallic substrate, as set forth in claim 15, wherein the composition of the primary layer of said second transition layer comprises about 67% of said ceramic material and about 33% of said metallic material, and the composition of the secondary layer comprises about 67% of said metallic material and about 33% of said ceramic material.

17. A coating for a metallic substrate, as set forth in claim 1, wherein said second transition layer has a thickness of from about 0.13 mm to about 0.60 mm.

18. A coating for a metallic substrate, as set forth in claim 17, wherein the thickness of said second transition layer is about 0.40 mm.

19. A coating for a metallic substrate, as set forth in claim 1, wherein said metallic seal coat is formed of an oxidation resistant refractory metal material.

20. A coating for a metallic substrate, as set forth in claim 19, wherein the oxidation resistant refractory metal material comprising said metallic seal coat has a composition comprising about 75% nickel, about 17.5% chromium, about 5.5% aluminum, about 2.5% cobalt, and about 0.5% yttria.

21. A coating for a metallic substrate, as set forth in claim 1, wherein said metallic seal coat has a thickness of from about 0.13 mm to about 0.30 mm.

22. A coating for a metallic substrate, as set forth in claim 21, wherein the thickness of said metallic seal coat is about 0.20 mm.

* * * * *